United States Patent [19]

Cumbers

[11] B 3,991,669

[45] Nov. 16, 1976

[54] CALENDER PRESSES

[75] Inventor: David Charles Cumbers, Pontypool, England

[73] Assignee: Imperial Chemical Industries Limited, London, England

[22] Filed: Jan. 14, 1974

[21] Appl. No.: 432,991

[44] Published under the second Trial Voluntary Protest Program on March 2, 1976 as document No. B 432,991.

[30] Foreign Application Priority Data

Jan. 17, 1973 United Kingdom ..... 2394/73

[52] U.S. Cl. ..... 100/162 B; 100/163 R; 100/170; 29/116 AD

[51] Int. Cl.[2] ..... B30B 3/04

[58] Field of Search ..... 100/155–172, 100/176; 29/113 AD, 116 AD; 162/358, 359

[56] References Cited

UNITED STATES PATENTS

| | | | |
|---|---|---|---|
| 864,660 | 8/1907 | Love | 100/160 |
| 1,803,926 | 5/1931 | Vedder | 100/160 |
| 2,191,144 | 2/1940 | Hornbostel | 100/176 X |
| 2,800,012 | 7/1957 | Goetz et al. | 100/160 X |
| 2,850,952 | 9/1958 | Hornbostel | 100/163 R |
| 2,970,339 | 2/1961 | Hausman | 100/162 B |
| 3,266,414 | 8/1966 | Wahlstrom et al. | 100/163 R |
| 3,389,448 | 6/1968 | Buysch | 29/110 |
| 3,451,331 | 6/1969 | Frederickson et al. | 100/162 R |
| 3,572,570 | 3/1971 | Mortensen et al. | 100/170 |

FOREIGN PATENTS OR APPLICATIONS

| | | | |
|---|---|---|---|
| 788,450 | 1/1958 | United Kingdom | 100/155 R |

*Primary Examiner*—Peter Feldman
*Attorney, Agent, or Firm*—Cushman, Darby & Cushman

[57] ABSTRACT

A calender press with improved uniformity of nip pressure comprising a conventional axially located and relatively rigid roll co-operating with a hollow and relatively compliant roll, and means to support the compliant roll along its length and urge it into contact with the rigid roll.

28 Claims, 8 Drawing Figures

CALENDER PRESSES

The invention relates to improvements in calender presses and similar devices which comprise two rolls having substantially parallel axes and arranged in touching contact and also means to urge the said rolls together at a predetermined pressure, wherein sheet articles may be passed between the said two rolls and subjected to the said predetermined pressure. Such devices are referred to hereinafter as calender presses for simplicity.

It is clearly desireable that the nip pressure (that is the pressure exerted on the sheet article per unit length of roll) be a constant value across the entire length of the roll, but in practice it is found to be extremely difficult to ensure that this desideratum is met, particularly at high applied nip pressures, and with long rolls, since in practice the rolls do not behave as rigid beams but bow under the applied pressure and/or sag under their own weight. The problem of non-uniform nip pressure is accentuated when one or both rolls are heated because of differential thermal expansion, which may in fact vary with time, particularly after a sheet material has first been introduced between the rolls, as the added thermal load may cause additional temperature (and hence, nip pressure) fluctuations. Nip pressure fluctuations will also arise if the sheet material being treated is itself not uniform in thickness.

In some cases, such as in the embossing or bonding of a textile at a multiplicity of points, that is when one or both rolls are machined to have a multiplicity of protrusions on their surface, the sheet article is found to be extremely critical to variations in nip pressure, and undue variations in nip pressure are therefore not acceptable.

Various methods for reducing the variation in nip pressure in calender presses have been proposed. It has, for example, been proposed that one of the rolls is machined so as to have a slightly greater diameter at its centre than at its ends, in order to compensate for sagging of the pair of rolls under their own weight and for bowing of the rolls under applied pressure, such rolls being referred to as "crowned" or "cambered" rolls. However, the "degree of crowning" is designed to be correct for one applied load and one temperature, and variation from those specific design conditions causes non-uniform nip pressure, so that calender presses incorporating crowned rolls lack versatility. Elsewhere it has been suggested that the axles of the rolls should extend beyond their support bearings and be loaded to introduce bending in an attempt to counteract sagging, or that fluids be supplied under high pressure to the interior of hollow rolls, the latter arrangement necessitating an external source of high pressure fluid. Such proposals do indeed reduce variations in nip pressure but require extremely complicated and costly engineering without providing a versatile calender press capable of operating in an acceptable manner over a range of pressures or temperatures.

It is an object of this invention to provide a calender press or the like in which variations in nip pressures about a required value are considerably reduced. It is a further object to provide a calender press or the like in which variations from uniform nip pressure whether caused by a non-uniform and varying temperature distribution along the roll, or by the treatment of a non-uniform sheet material, are reduced. Another object of the invention is to provide a calender press or the like which is able to operate over a range of applied pressures or temperatures without unacceptable variations in the nip pressure arising. These and other objects which will be apparent from the description that follows are achieved by forming one of the rolls of the calender press which cooperate to form the nip through which the sheet article is passed from a hollow tubular member of such dimensions that that roll is able to deform to accommodate distortions in its companion roll or variations in the thickness of the sheet article. Accordingly, the invention provides a calender press or the like comprising two rolls having substantially parallel axes and arranged in touching contact to define a nip therebetween, one of said rolls being a substantially rigid roll axially located and supported, the second of said rolls being a hollow cylinder having means to locate it and means to support it along its length and urge it under a load into contact with said first roll to generate a desired mean nip pressure in said nip, said hollow cylinder having such dimensions that it is responsive to fluctuations from said desired mean nip pressure along the length of said nip by elastic deformation which results in the minimisation of said fluctuations from said desired mean nip pressure.

We call in this specification the hollow cylinder which acts to minimise fluctuations from the desired nip pressure by elastic deformation a "compliant roll". The other roll with which the compliant roll defines the nip is referred to for convenience, as a "conventional roll".

The compliant rolls of calender presses according to the invention are able to conform under strain to reduce variations in the nip pressure. The nip pressure variation may arise from distortion of the rolls such as by bowing or sagging or "barrelling", the latter being the phenomenon where parts of the rolls assume a greater diameter than other portions due to uneven expansion as a result of uneven temperature distribution. Another source of variable nip pressure is uneven thickness in the sheet article which is being treated. The compliant roll deforms elastically to overcome these irregularities by bending (that is when its axis becomes curved) and by squashing (that is when its cross-section in planes transverse to its axis ceases to be circular), or by a combination of both modes of distortion.

The compliant rolls used in the calender presses of our invention should be located in the press in a manner which does not affect their ability to deform elastically along the length of the nip. Hence they should not be provided with end-pieces carrying axles for their location unless the compliant rolls extend beyond the nip by a sufficient distance that the stiffening effect of the end-piece is negligible in the actual nip.

Since the compliant rolls are readily deformable it is necessary to support them along their entire length and not merely at their extremities.

The support for the compliant rolls may also serve to locate and retain them in the desired position in the calender press.

Substitution of a compliant roll for one conventional roll in a calender press in which a nip is defined between two conventional rolls is found always to reduce the variation from uniform nip pressure, and to increase the versatility of the press (that is its ability to operate satisfactorily over a range of loads and temperatures). However, two conflicting factors should be borne in mind when choosing the dimensions of the compliant roll. Firstly, the less the ratio of the diametral stiffness of the compliant roll to the flexural stiffness of the rest of the system (that is the combined stiffness of support and conventional roll), the less the fluctuations from uniform nip pressure will be. Stiffness of a compliant roll is reduced by choosing a large diameter and a small wall thickness, as well as choice of materials. On the other hand, the stresses set up in the compliant roll should be taken into account, since otherwise unduly high stresses will arise which will limit the working life of the compliant roll. The maximum stress in the compliant roll, $\sigma$, is given by $$\sigma \cong 2\frac{PR}{t^2}$$

where $P$ is the load per unit length applied to the roll, $R$ is the roll radius $t$ is the wall thickness.

Hence for a given ratio of radius to wall thickness the larger the diameter of the compliant roll, the lower the stresses. It will be seen that the two factors influencing the design of the compliant roll act in opposite senses and that the actual values of wall thickness and diameter chosen will be compromise values which will need to be determined by the operator. For use involving the treatment of textiles, compliant rolls having a wall thickness and diameter such that they can deform elastically by between 0.25 and 2.5 mm under an applied load of 80 Kg per centimeter length of roll, are found to be useful. We have found the following empirical limits for useful compliant rolls:

$$Rt^{-2} \ngtr 13;\ Rt^{1/2} \nless 40$$

where $R$ is the radius in millimeters and $t$ is the wall thickness in millimeters.

Depending on the material of which the compliant roll is made, these limits may need to be further restricted in order to ensure a useful lifetime. For example, with compliant rolls made of aluminium alloys, we find that the following limits should be observed:

$$Rt^{-2} \ngtr 8;\ Rt^{1/2} \nless 50$$

It will be appreciated that compliant rolls can be manufactured with dimensions which fall outside the above quoted relationships. However, such rolls will be less useful than rolls within the preferred limits, since either their life will be unduly limited, or on the other hand their ability to deform elastically under deviations from a preferred mean nip pressure across the roll will be impaired.

Aluminium alloys or steels are particularly useful materials from which to make the compliant rolls for use in the calenders presses according to the invention. It is also preferred that the compliant rolls and the conventional rolls have a surface hardness of at least 100 measured on the Vickers Scale of Hardness, so that they are resistant to permanent local deformation arising from, say a localised high spot on one roll.

In order to illustrate and explain the invention further a number of possible applications will now be described, with reference to the accompanying drawing.

In the drawing

Figure 1:
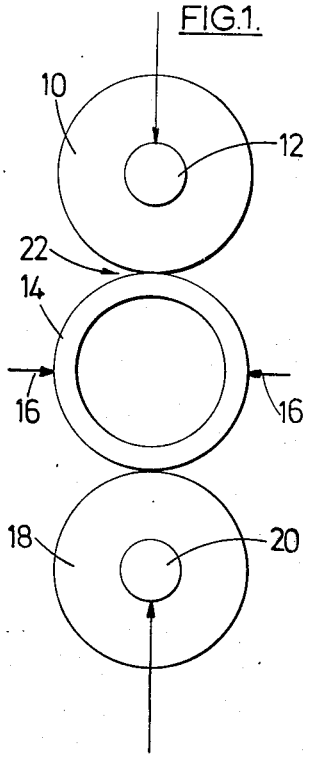
FIG. 1 is a diagrammatic end-elevation of one type of calender press according to the invention.
Figure 2:
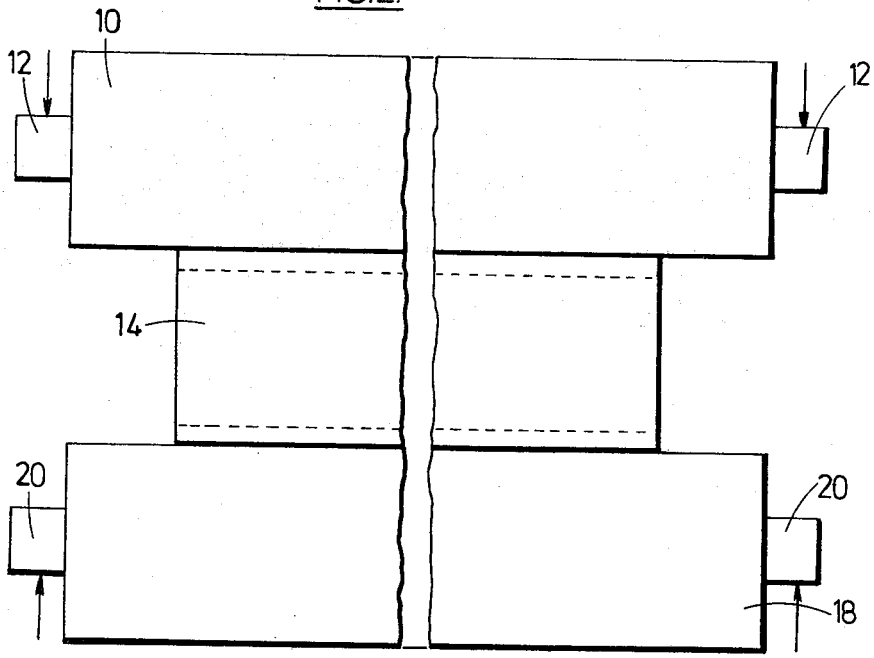
FIG. 2 is a side elevation of a second arrangement of calender press according to the invention.

Referring to FIGS. 1 and 2, a calender press or the like comprises a conventional, rigid roll 10 having axle 12, in contact along at least part of its length with a hollow, thin-walled compliant roll 14, nip 22 is defined between rolls 10 and 14. Compliant roll 14 is located by means indicated by arrows 16 (FIG. 1 only) which means are described more fully hereinafter, and is supported by support roll 18 having axle 20. A load is exerted on axles 12 and 20 (indicated by arrows) and results in the desired mean nip pressure being generated in nip 22.

Figure 3:
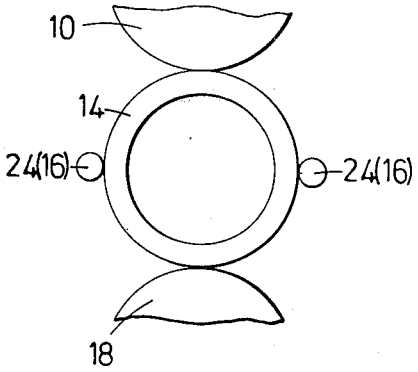
FIG. 3 is a fragmentary diagrammatic end-section of the calender press of FIG. 1, illustrating the means of location of the compliant roll.

In FIG. 3, locating means 16 are exemplified by small rolls 24 which are rotatably mounted adjacent to the outer surface and at each end of compliant roll 14.

Figure 4:
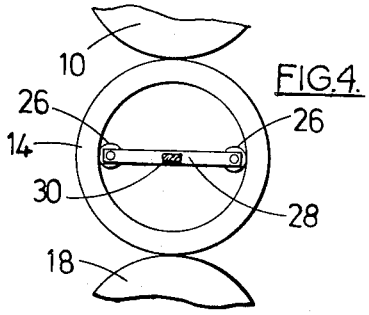
FIG. 4 is a fragmentary diagrammatic end-section of the calender press of FIG. 1, illustrating another means of location of the calender roll.

Alternate locating means 16, shown in FIG. 4, comprise small rotatably mounted rolls 26 mounted within the interior compliant roll 14, to bracket 28 which is itself fixed to rigidly mounted member 30.

Figure 5:
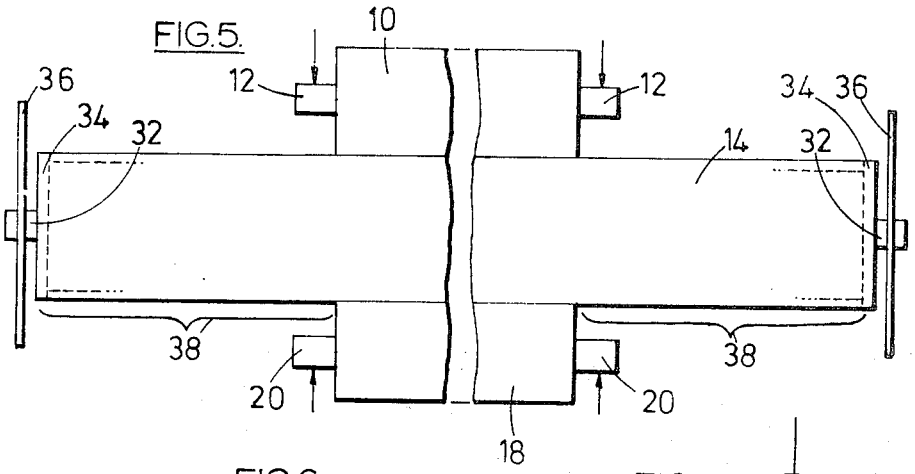
FIG. 5 is a side elevation of a second arrangement of calender press according to the invention.

In FIG. 5 compliant roll 14 extends beyond conventional roll 10 and support roll 18 and is provided at its ends with endpieces 34 carrying stub axles 32. Axles 32 locate in grooves or slots in rigidly mounted members 36, and by this means compliant roll 14 is located and retained in position. The portions 38 of compliant roll 14 are of sufficient length to ensure that the stiffening effect of end-pieces 34 is negligible over the central portion of compliant roll 14 where it is in contact with roll 10 (that is over the length of the nip).

It may be advantageous in the design of calender rolls of the type illustrated in FIGS. 1, 2 and 5 to arrange for the compliant roll 14 to be offset slightly from the plane joining the axes of conventional roll 10 and support roll 18 so that it may be more positively located by means 16. Preferably the compliant roll 14 is offset slightly on the exit side of the calender press, that is on the side that the sheet article emerges after passing through the nip.

As mentioned above it is advantageous that the ratio stiffness of the compliant roll to the stiffness of the rest of the system (that is the combined stiffness of conventional roll and support roll) is small. For the type of calender illustrated in FIG. 1, we prefer that the "stiffness ratio", S, should be between 1 and 0.1, most preferably between 0.3 and 0.1 where $$S = 0.7\left(\frac{t_2}{R_2}\right)^3\left[\frac{E_2}{E_1}\left(\frac{L}{D_1}\right)^4 + \frac{E_2}{E_3}\left(\frac{L}{D_3}\right)^4\right]$$

where $D_1$ and $E_1$ are the diameter of, and Young's Modulus of the material of, the conventional roll, $R_2$, $t_2$ and $E_2$ are the radius, wall thickness and Young's Modulus of the material, of the compliant roll $D_3$ and $E_3$ are the diameter of, and Young's Modulus of the material of, the support roll.

Figure 6:
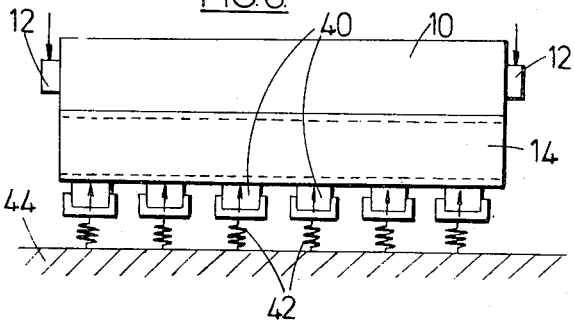
FIG. 6 is a diagrammatic view illustrating one means of support of a compliant roll.

FIG. 6 illustrates an alternative support means for the compliant roll. A plurality of small rolls 40 are supported by springs 42 attached to rigid support 44. Rolls 40 in turn support compliant roll 14 and urge it against conventional roll 10. Springs 42 may advantageously be replaced by hydraulic cylinders and the pressure exerted by rolls 40 on compliant roll 14 may thereby be maintained at a constant value. The axes of rolls 40 all lie in the same plane.

Figure 7:
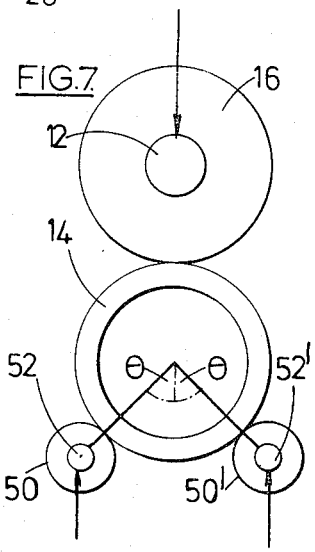
FIG. 7 is a diagrammatic end-elevation of an alternative type of calender press according to the invention.

In FIG. 7 compliant roll 14 contacts conventional roll 10 and is supported and located by twin support rolls 50, 50¹ provided with axles 52, 52¹ respectively which are upwardly loaded as indicated by arrows. Support rolls 50, 50¹ may be conventional rigid rolls or may be the multiple small roll system illustrated in FIG. 6.

For this system with identical support rolls, if the planes of deflection of each support roll are inclined at an angle of 2 to each other (as shown in FIG. 7) and symmetrically with respect to the plane of deflection in the nip then we find that the stiffness ratio S is given by $$S = \frac{1.33\left(\frac{t}{R}\right)^3\left[\frac{E_2}{E_1}\left(\frac{L}{D_1}\right)^4 + \frac{E_2}{E_3}\left(\frac{L}{D_2}\right)^4 \frac{\mathrm{Sec}^2\,\Theta}{2}\right]}{[(\pi-\Theta)(\pi+\Theta\tan^2\Theta)+\pi\tan\Theta-2(1+\mathrm{Sec}\,\Theta)^2]}$$

where $\Theta$ is expressed in radians $t$ is the wall thickness of the compliant roll R is the radius of the compliant roll $E_2$ is the Young's Modulus of the material of the compliant roll $E_1$ is the Young's Modulus of the material of the conventional roll $D_1$ is the diameter of the conventional roll $E_3$ is the Young's Modulus of the material of the support rolls $D_3$ is the diameter of the support rolls We prefer S to be between 1 and 0.1, most preferably between 0.3 and 0.1.

The system illustrated in FIG. 7 has the advantage that location and support of the compliant roll is combined and the additional locating devices as illustrated in FIGS. 3 and 4 and required by the system of FIG. 1 are not necessary. On the other hand the system of FIG. 7 tends to limit the ability of the compliant roll to deform elasticity, especially when the separation of the support rolls ($2\Theta$) is considerable.

Figure 8:
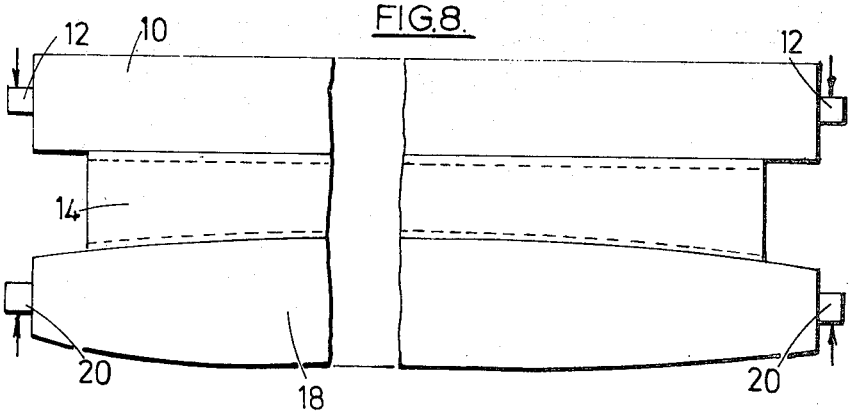
FIG. 8 is a diagrammatic side-elevation of a variant of the calender press illustrated in FIGS. 1 and 2 incorporating a crowned support roll.

FIG. 8 shows a variant of the calender press of FIGS. 1 and 2 in which support roll 18 is crowned. As stated previously, crowning is a known technique for the reduction of nip pressure variation in calender presses, and is discussed inter alia by H E Kuehn, *Paper Trade Journal,* 18 July 1960 ("A new approach to Roll Crowning - particularly for Calenders") and by M D Stone and A T Liebart, in TAPPI, 44, No 5, May 1961 ("Crown Control of Paper Calenders"). The amount of crowning is calculated from a knowledge of the properties of the materials, dimensions of rolls, and the desired nip pressure and operational temperatures. Variation from the specified design values leads to non-uniform nip pressure and the calender press is therefore lacking in versatility. However, making the crowned roll of a calender press a compliant roll permits the press to be operated at conditions of pressure and temperature other than those for which the crowning of the roll was calculated.

A similar arrangement to that illustrated in FIG. 8 may incorporate the multiple small roll system of FIG. 6 as the support means, wherein the pressure exerted by the small rolls progressively increases towards the centre of the compliant roll.

What we claim is:

1. A calender press or the like comprising two hard-surfaced cooperating rolls having substantially parallel axes and arranged to define a nip therebetween, at least one of said rolls being a hollow cylinder provided with means locating it with respect to the other roll and with means engaging and supporting it at least substantially along the length of the nip and urging it toward the other roll to generate a desired nip pressure in the nip, the diameter and wall thickness of said hollow cylinder being such that said hollow cylinder is elastically deformable by bending or by squashing or both and thereby accomodates distortions in said other roll or variations in thickness of sheet material passing through the nip to reduce variations in nip pressure along the length of the nip, the radius, R, and the wall thickness, $t$, of the hollow cylinder having the limits $$Rt^{-2} \not> 13$$
$$Rt^{1/2} \not< 40$$

where

R and t are in millimeters.

2. A calender press or the like as claimed in Claim 1 wherein said hollow roll is located by small auxiliary rolls which bear on the external surface thereof.

3. A calender press or the like as claimed in Claim 2 wherein said auxiliary rolls bear on said hollow roll towards its ends.

4. A calender press or the like as claimed in Claim 1 wherein said means to support said hollow roll comprises a substantially rigid roll located with its axis substantially in the plane passing through the axes of said co-operating rolls

5. A calender press or the like as claimed in Claim 1 wherein said means to support said hollow roll comprises a series of small rolls the axes of which all lie in the same plane which is substantially the same plane as that passing through the axes of said co-operating rolls said small rolls being urged under pressure into contact with said hollow roll.

6. A calender press or the like as claimed in Claim 5 wherein said small rolls are urged by hydraulic means against said second roll.

7. A calender press or the like as claimed in Claim 1 in which at least one co-operating roll is crowned.

8. A calender press or the like as claimed in Claim 5 wherein said small rolls are urged into contact with said hollow roll by a pressure which progressively increases towards the centre of said second roll.

9. A calender press or the like as claimed in claim 1 wherein the stiffness ratio, S, of the calender press has a value between 1 and 0.1 where $$S = 0.7 \left(\frac{t_2}{R_2}\right)^3 \left[\frac{E_2}{E_1}\left(\frac{L}{D_1}\right)^4 + \frac{E_2}{E_3}\left(\frac{L}{D_3}\right)^4\right]$$

where $D_1$ and $E_1$ are the diameter of, and Young's Modulus of the material of said other roll, $R_2$, $t_2$ and $E_2$ are the radius, wall thickness and Young's Modulus of the material, of said hollow cylinder, $D_3$ and $E_3$ are the diameter of, and Young's Modulus of the material of said support means.

10. A calender as claimed in Claim 1 in which said means to support said hollow roll comprises a plurality of substantially rigid rolls.

11. A calender as claimed in Claim 1 in which said means to support said hollow roll comprises a plurality of series of small rolls, the axes of the small rolls within each series lying in the same plane.

12. A calender press or the like as claimed in Claim 10 wherein said plurality of rolls are symmetrically disposed with respect to the plane passing through the axes of said co-operating rolls.

13. A calender according to Claim 4 in which a substantially rigid support roll is crowned.

14. A calender press or the like as claimed in Claim 1 wherein the hollow roll deforms elastically between 0.25 mm and 2.5 mm under a load of 80 Kg per centimeter of its length.

15. A calender press or the like comprising two hard-surfaced cooperating rolls having substantially parallel axes and arranged to define a nip therebetween, at least one of said rolls being a hollow cylinder provided with means locating it with respect to the other roll and with means engaging and supporting it at least substantially along the length of the nip and urging it toward the other roll to generate a desired nip pressure in the nip, the diameter and wall thickness of said hollow cylinder being such that said hollow cylinder is elastically deformable by bending or by squashing or both and thereby accomodate distortions in said other roll or variations in thickness of sheet material passing through the nip to reduce variations in nip pressure along the length of the nip, the stiffness ratio, S, of the calender press having a value between 1 and 0.1 where $$S = 0.7 \left(\frac{t_2}{R_2}\right)^3 \left[\frac{E_2}{E_1}\left(\frac{L}{D_1}\right)^4 + \frac{E_2}{E_3}\left(\frac{L}{D_3}\right)^4\right]$$

where $D_1$ and $E_1$ are the diameter of, and Young's Modulus of the material of said other roll, $R_2$, $t_2$ and $E_2$ are the radius, wall thickness and Young's Modulus of the material, of said hollow cylinder, $D_3$ and $E_3$ are the diameter of, and Young's Modulus of the material of said support means.

16. A calender press or the like as in claim 15 wherein said hollow cylinder is located by small auxiliary rolls which bear on the external surface thereof.

17. A calender press or the like as in claim 16 wherein said auxiliary rolls bear on said hollow roll towards its ends.

18. A calender press or the like as in claim 15 wherein said means to support said hollow roll comprises a substantially rigid roll located with its axis substantially in the plane passing through the axes of said co-operating rolls.

19. A calender press or the like as in claim 15 wherein said means to support said hollow roll comprises a series of small rolls the axes of which all lie in the same plane which is substantially the same plane as that passing through the axes of said co-operating rolls said same rolls being urged under pressure into contact with said hollow roll.

20. A calender press or the like as in claim 19 wherein said small rolls are urged by hydraulic means against said second roll.

21. A calender press or the like as in claim 15 in which at least one co-operating roll is crowned.

22. A calender press or the like as in claim 19 wherein said small rolls are urged into contact with said hollow roll by a pressure which progressively increases towards the centre of said second roll.

23. A calender press or the like as in claim 15 in which said means to support said hollow roll comprises a plurality of substantially rigid rolls.

24. A calender press or the like as in claim 15 in which said means to support said hollow roll comprises a plurality of series of small rolls, the axes of the small rolls within each series lying in the same plane.

25. A calender press or the like as in claim 23 wherein said plurality of rolls are symmetrically disposed with respect to the plane passing through the axes of said co-operating rolls.

26. A calender press or the like as in claim 18 in which a substantially rigid support roll is crowned.

27. A calender press or the like as in claim 15 wherein the hollow roll deforms elastically between 0.25 mm and 2.5 mm under a load of 80 Kg per centimeter of its length.

28. A calender press or the like as in claim 15 wherein the radius, R, and the wall thickness, $t$, of the hollow roll having the limits $$Rt^{-2} \ngtr 13$$
$$Rt^{1/2} \nless 40$$

where

R and $t$ are in millimeters.

* * * * *